US007992591B2

(12) United States Patent
Delamarche

(10) Patent No.: US 7,992,591 B2
(45) Date of Patent: Aug. 9, 2011

(54) MAGNETICALLY ACTUATED MICROFLUIDIC MIXERS

(75) Inventor: Emmanuel Delamarche, Thalwil (CH)

(73) Assignee: International Business Machines Corporation, Armonk, NY (US)

( * ) Notice: Subject to any disclaimer, the term of this patent is extended or adjusted under 35 U.S.C. 154(b) by 423 days.

(21) Appl. No.: 12/329,549

(22) Filed: Dec. 6, 2008

(65) Prior Publication Data

US 2010/0139797 A1 Jun. 10, 2010

(51) Int. Cl.
*F15C 1/04* (2006.01)

(52) U.S. Cl. ..... 137/831; 251/121; 251/129.14; 138/46; 366/349

(58) Field of Classification Search ..... 137/614.11, 137/825, 829, 831; 366/349; 138/45, 46; 251/121, 129.03, 129.14
See application file for complete search history.

(56) References Cited

U.S. PATENT DOCUMENTS 6,398,183 B1 * 6/2002 Kerger et al. ..... 251/65
6,606,922 B2 8/2003 Case et al.
6,802,489 B2 10/2004 Marr et al.
6,981,518 B2 1/2006 Gilbert et al.
7,033,148 B2 4/2006 Bunner et al.
2004/0265150 A1 12/2004 McElfresh et al.
2005/0116798 A1 6/2005 Bintoro et al.
2010/0140517 A1 * 6/2010 Delamarche ..... 251/65
2010/0143193 A1 * 6/2010 Delamarche ..... 422/68.1

* cited by examiner

*Primary Examiner* — Craig M Schneider
(74) *Attorney, Agent, or Firm* — Stephen C. Kaufman

(57) ABSTRACT

In one embodiment as described in this section, an apparatus for mixing of microfluidic streams on a chip is presented, which comprises a micro-channel and a plurality of magnetic valves on the chip. A guiding magnet produces a proximal magnetic field gradient to exert a force on a bead in a cavity when placed at in a vicinity of the chip. The bead-cavity combination form a magnetic valve. In one embodiment, the mouth of the cavity is tapered so to prevent the magnetic bead from completely blocking the corresponding micro-channel section to enhance the mixing of microfluidic streams at the narrowed fluid path. In one embodiment, magnetically actuated valves direct the flow in a microfluidic system in one of several flow paths wherein the mixing characteristics of the paths are different.

1 Claim, 15 Drawing Sheets

MAGNETICALLY ACTUATED MICROFLUIDIC MIXERS

This application is related to 2 other co-pending applications (but different inventions), with same assignee and common inventor(s), titled "Magnetic valves for performing multi-dimensional assays" and "One-step flow control for crossing channels".

BACKGROUND OF THE INVENTION

Microfluidics systems are miniaturized systems wherein chemical, biochemical, or biological reactions occur. Microfluidics can also be used in analytical systems. Microfluidics are used due to, but are not limited to, integration with several functionalities, integrated to one system, portability, short time to result, and economical use of samples and reagents.

The flow regime of liquids in microfluidics is generally laminar, turbulence phenomena are absent and diffusion of species in liquids (analytes, reactants, etc.) is passive. For example, two parallel liquids that enter a same microchannel do not mix well and their flows essentially remain separate parallel streams. The lack of mixing or an inefficient mixing in microfluidics is therefore a commonly encountered problem.

Mixing is usually implemented using actuated elements that physically move and change the flow path of liquids to make their flow less laminar. This adds to the complexity and cost of the fabrication and use of microfluidic systems. Mixing is sometimes performed using passive mixers.

Passive mixers are usually microstructures (e.g. curved or otherwise shaped microchannels) that modify the direction of flow of streams of liquid or that enhance the interface (contact area) between adjacent streams of liquid (e.g. flow splitters). Some passive mixers induce chaotic, turbulent flow in liquids. However, these mixers have characteristics defined by design and cannot be modified during usage of the microfluidics.

Particles have been used to stir liquids and generate mixing but this requires continuous actuation for moving the particles in a region of a microfluidic. For example, magnetic particles are rotated using a magnetic field or charged particles are moved using an electrical field.

SUMMARY OF THE INVENTION

In one embodiment, as described in this section, an apparatus for mixing of microfluidic streams on a chip is presented and comprises a micro-channel and a series of magnetic valves on the chip. A guiding magnet produces a proximal magnetic field gradient when an operator places the guiding magnet in a vicinity of the chip. A magnetic valve of the plurality of magnetic valves controls fluid flow in the micro-channel.

In one embodiment, the mouth of the cavity is tapered in order to force the magnetic bead partially into the flow in the microchannel to enhance the mixing of microfluidic streams at the narrowed fluid path while preventing the magnetic bead from completely blocking the corresponding micro-channel section. In one embodiment, magnetically actuated valves direct a liquid in a microfluidic system in one of several flow paths wherein the mixing characteristics of the paths are different.

The valves can be actuated by hand, and by moving a magnet in the vicinity of the valve in one direction. Such actuation is reversible, the corresponding fabrication is simple and inexpensive, no peripheral equipment needed (the magnet excepted), its use is simple and valves can be actuated at any time during use of the microfluidic system even by a non-expert user.

DETAILED DESCRIPTION OF THE PREFERRED EMBODIMENTS

Figure 1:
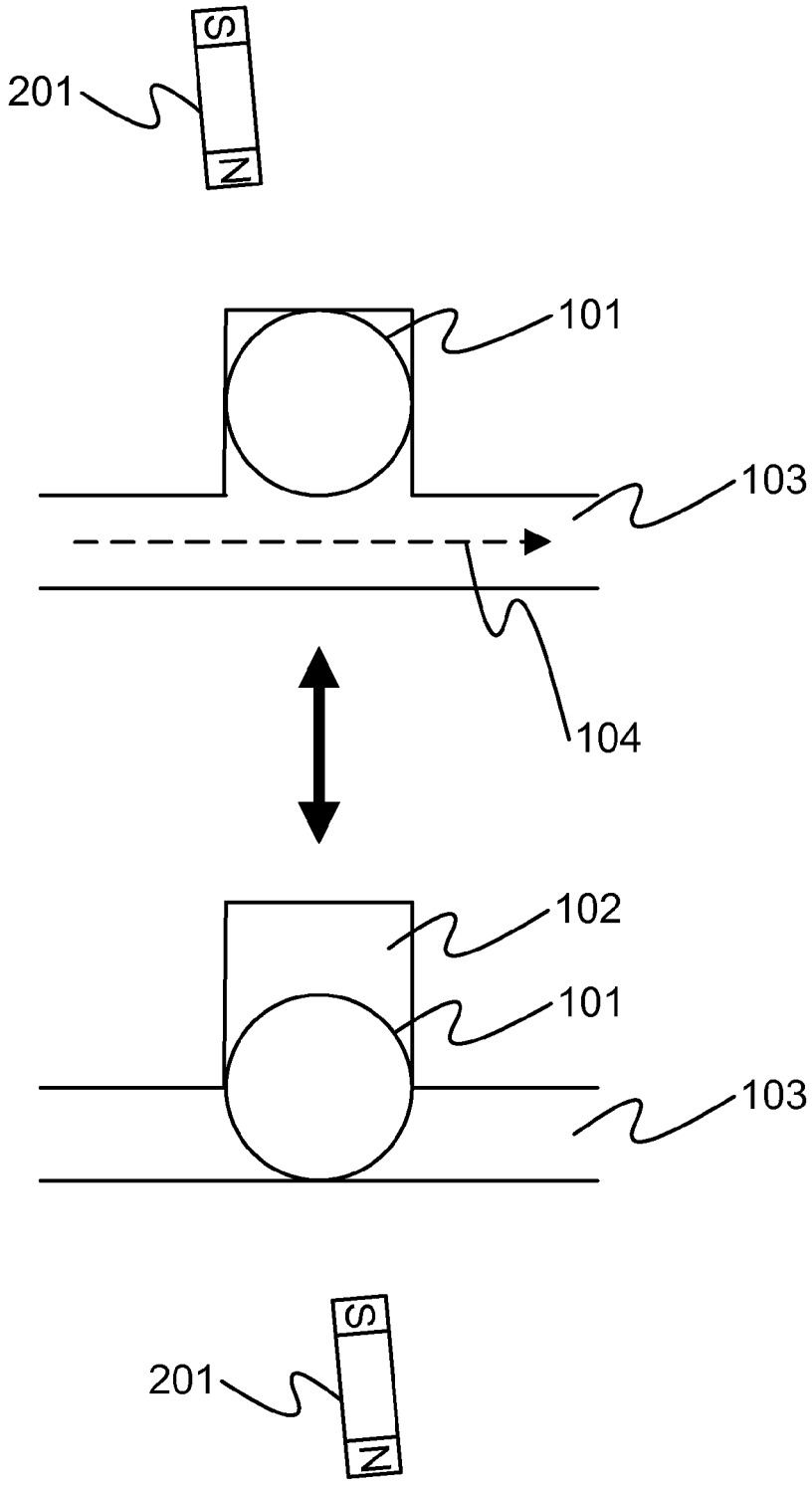
FIG. 1 illustrates schematically the mechanism of closing the microchannel using a bead.

In one embodiment as described in this section, an apparatus for mixing of microfluidic streams on a chip is presented. The apparatus of this example comprises a microchannel on the chip and a plurality of magnetic valves on the chip. A guiding magnet produces a proximal magnetic field gradient at a location of each of the plurality of magnetic valves when an operator places the guiding magnet in a vicinity of the chip.

In one embodiment, a first magnetic valve of the plurality of magnetic valves controls fluid flow in the micro-channel. Each magnetic valve of the plurality of magnetic valves comprises a magnetic bead and a cavity on the chip next to a corresponding micro-channel section of the micro-channel.

In an embodiment, the magnetic bead comprises a magnetic volume element, which forces the magnetic bead to move along a cavity length of the cavity in response to the proximal magnetic field gradient, and a bead surface cover, which provides chemical resistance and reduces friction and stiction of the magnetic bead within the cavity.

In one embodiment, the cavity length is perpendicular to the corresponding micro-channel section, and has a closed end away from the corresponding micro-channel section and an open end at the corresponding micro-channel section. The open end is tapered so to prevent the magnetic bead from completely blocking the corresponding micro-channel section.

In one embodiment, each magnetic valve is at an on state, if the magnetic bead is at the closed end of the cavity length allowing an unconstraint fluid flow through the corresponding micro-channel section. Each magnetic valve is at a constricting state, if the magnetic bead is at the open end of the cavity length and partially blocking fluid flow through the corresponding micro-channel section by narrowing a fluid path at the corresponding micro-channel section to enhance the mixing of microfluidic streams at the narrowed fluid path.

In one embodiment, the vicinity of the chip comprises a plurality of guiding magnet position ranges. The operator repositions guiding magnet within the guiding magnet position ranges in order to actuate the plurality of magnetic valves simultaneously. If the guiding magnet is within a "maximum mixing" position range of the guiding magnet positions ranges, then each magnetic valve is simultaneously at the constricting state.

If the guiding magnet is within a high mixing position range of the plurality of guiding magnet positions ranges, then simultaneously, each magnetic valve in a first subset of the plurality of magnetic valves is at the constricting state, and each magnetic valve in a second subset of the plurality of magnetic valves is at the on state, Each magnetic valve is either in the first subset or in the second subset; i.e. it is either partially blocking the flow or is closed.

In one embodiment, if the guiding magnet is within a low mixing position range of the plurality of guiding magnet position ranges, then simultaneously, each magnetic valve in the first subset is at the on state, and each magnetic valve in the second subset is at the constricting state. If the guiding magnet is within a minimum mixing position range of the plurality of guiding magnet positions ranges, then each magnetic valve in the plurality of magnetic valves is simultaneously at the on state.

In one embodiment of the present invention, as shown in FIG. 1, a particle (101) having a magnetic volume element is moved in a proximal magnetic field gradient, from open (FIG. 1 top) position to close (FIG. 1 bottom) position. When in open position, the bead (101) allows for fluid flow (104) in the microchannel (103) and when it is in close position, it forms a cavity (102) and blocks the flow of liquid thus functioning as a valve. In the current example, magnetic valves as represented by Items 202 and 203 in FIG. 2 comprise of one or more bead (101), one or more cavities (102), and one or more microchannel (103).

The particle can be, for example, a polystyrene bead containing an iron oxide core with an overall diameter of 1-20 micrometer with an organic shell. Density, size, color, fluorescence, surface charges and/or chemistry of the particle (101) are well defined. As an example, the bead is covered by perfluorinated layer (2-5 nm thick) to minimize friction and stiction and provide chemical resistance. In one embodiment, the external magnetic element (201) is made from a rare earth alloy and beads can have dyes to allow direct visual control of the state of the valve. In one example, beads are placed with high control in cavities (102) using SATI.

In this embodiment, multiple beads or coated particles can be used for one valve, helping to relax positioning and fabrication issues, and improving efficiency of closed state. In addition, using multiple beads provides the possibility of having multi-state valves which are capable to open or close multiple passages simultaneously. In other embodiments, several valves can be placed in series to improve sealing efficiency. Furthermore, embodiments of this invention can be applied to create autonomous capillary systems with flow control.

Figure 2:
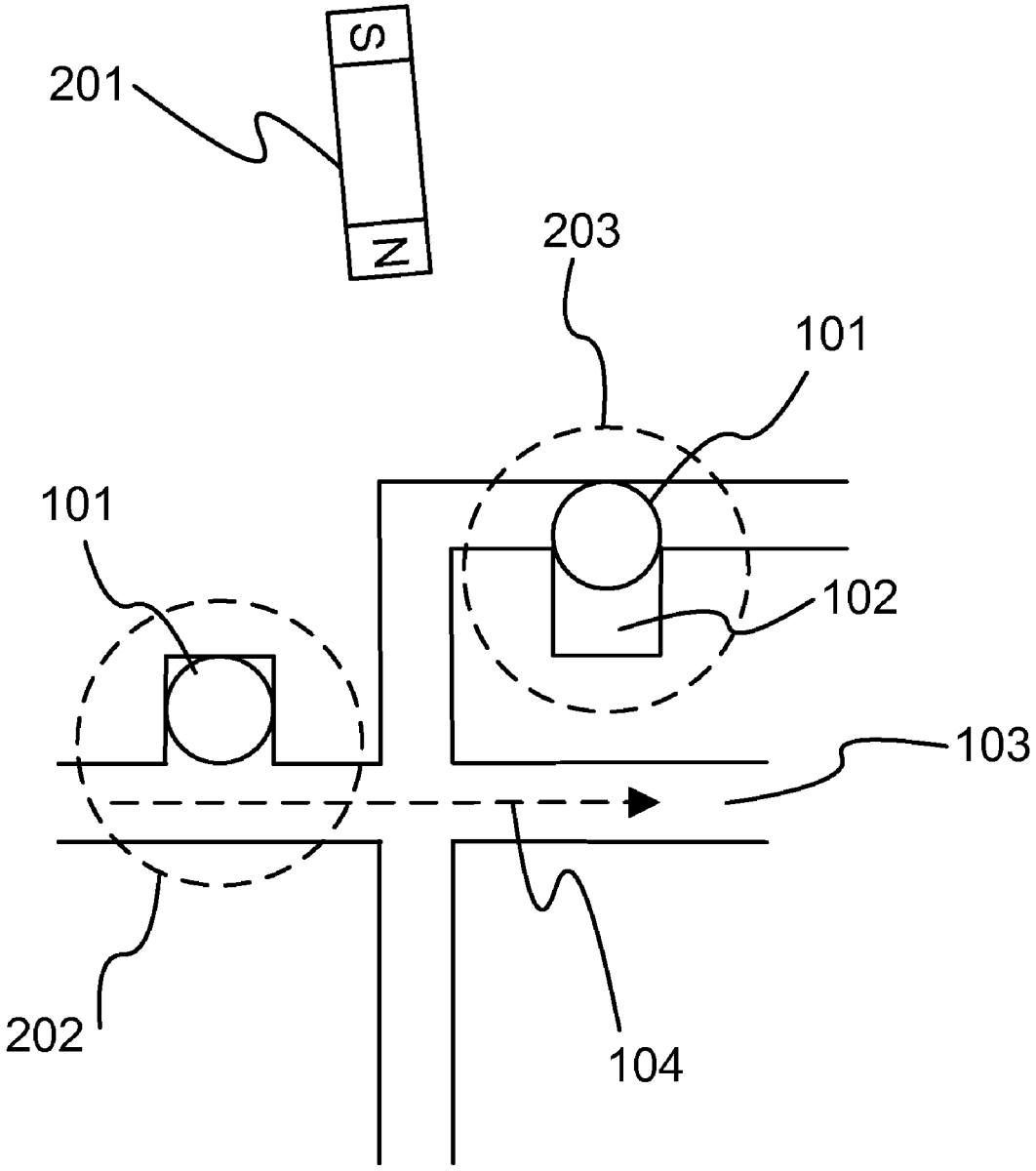
FIG. 2 illustrates schematically an application of the present invention at a crossing of two microchannels to allow a horizontal flow.
Figure 3:
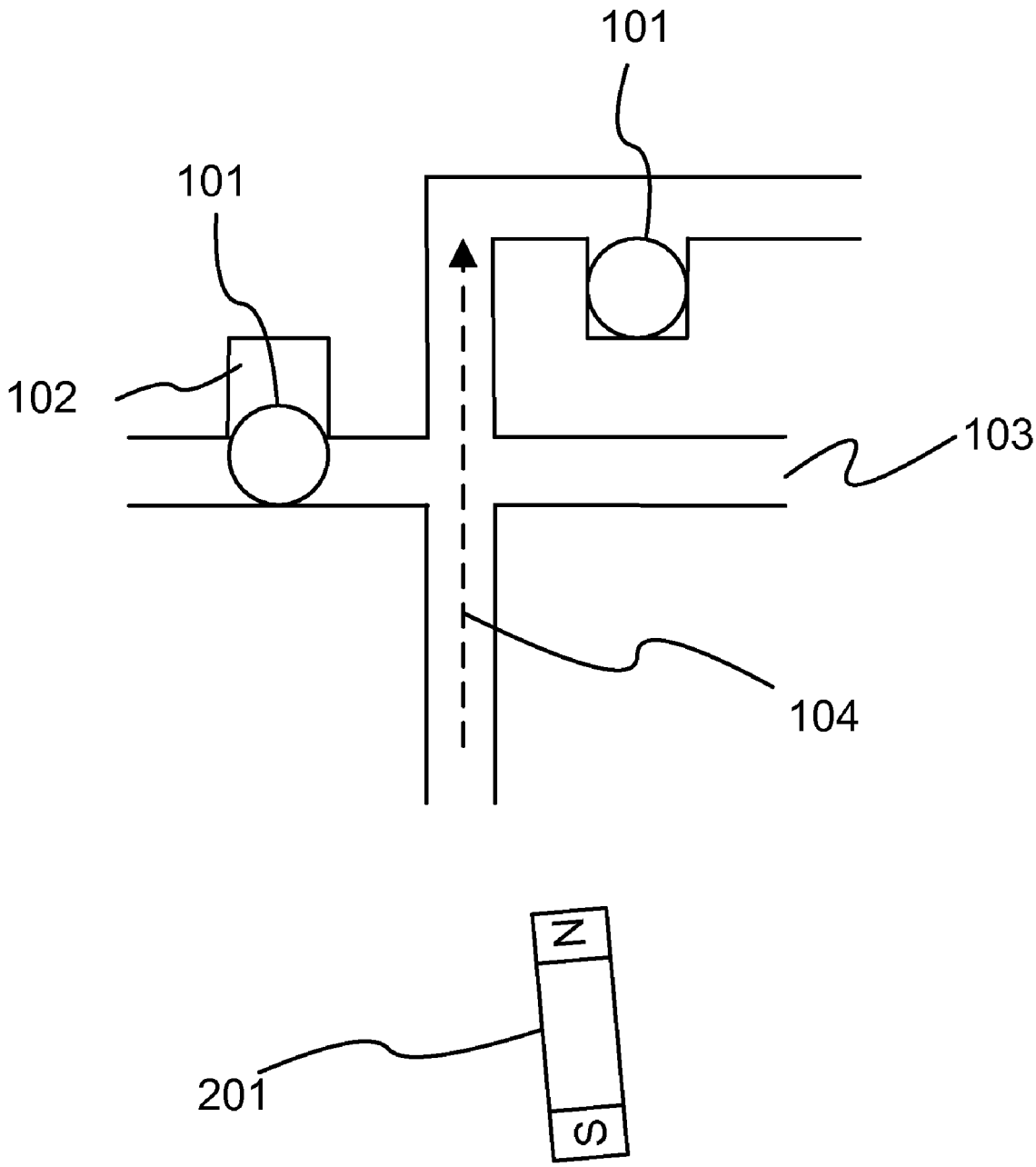
FIG. 3 illustrates schematically another application of the present invention at a crossing of two microchannels to allow a vertical flow.
Figure 4:
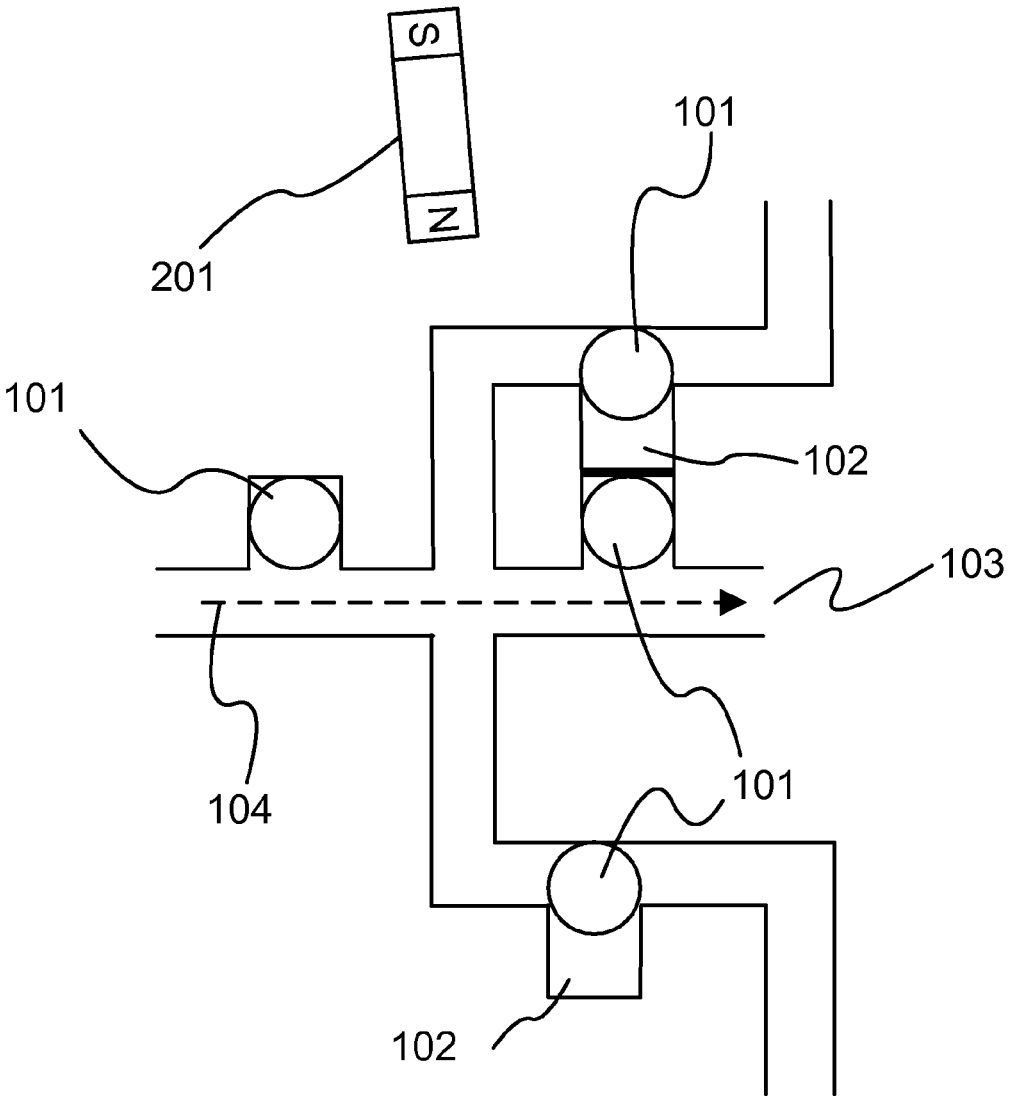
FIG. 4 illustrates schematically another configuration of the present invention at a crossing of two microchannels to allow a horizontal flow.
Figure 5:
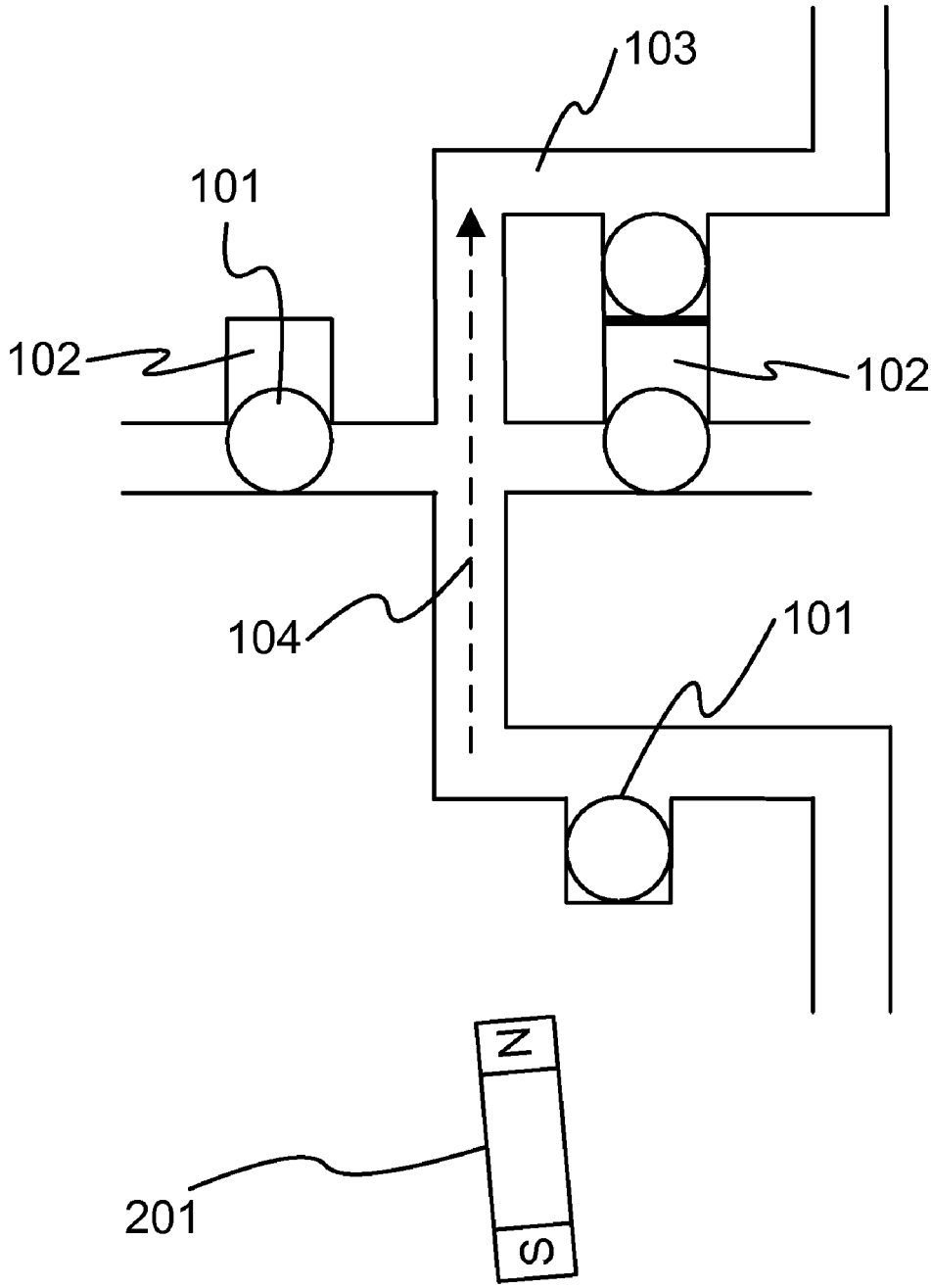
FIG. 5 illustrates schematically another configuration of the present invention at a crossing of two microchannels to allow a vertical flow.

In another embodiment, as shown in FIGS. 2 and 3, both beads move from one state to the other state simultaneously and due to one force. That is, the beads move up or down together. Another variation of this embodiment is one-step flow control in crossing channels with double valves as shown in FIG. 4 and FIG. 5. Similar to the previous case, by using double valves, both cases for the flow can be achieved.

Figure 6:
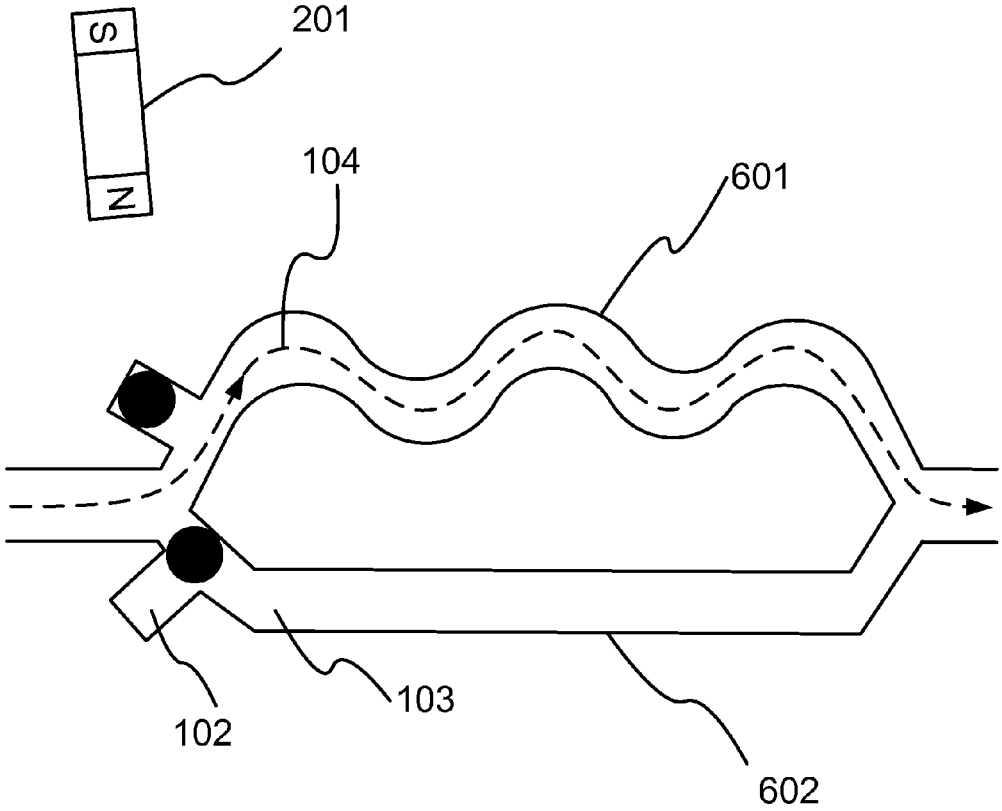
FIG. 6 and FIG. 7 illustrate schematically an embodiment of the present invention on regulating the extent of mixing in the flow stream. The extent of mixing is boosted as shown in FIG. 6 and is reduced in the situation shown in FIG. 7.
Figure 7:
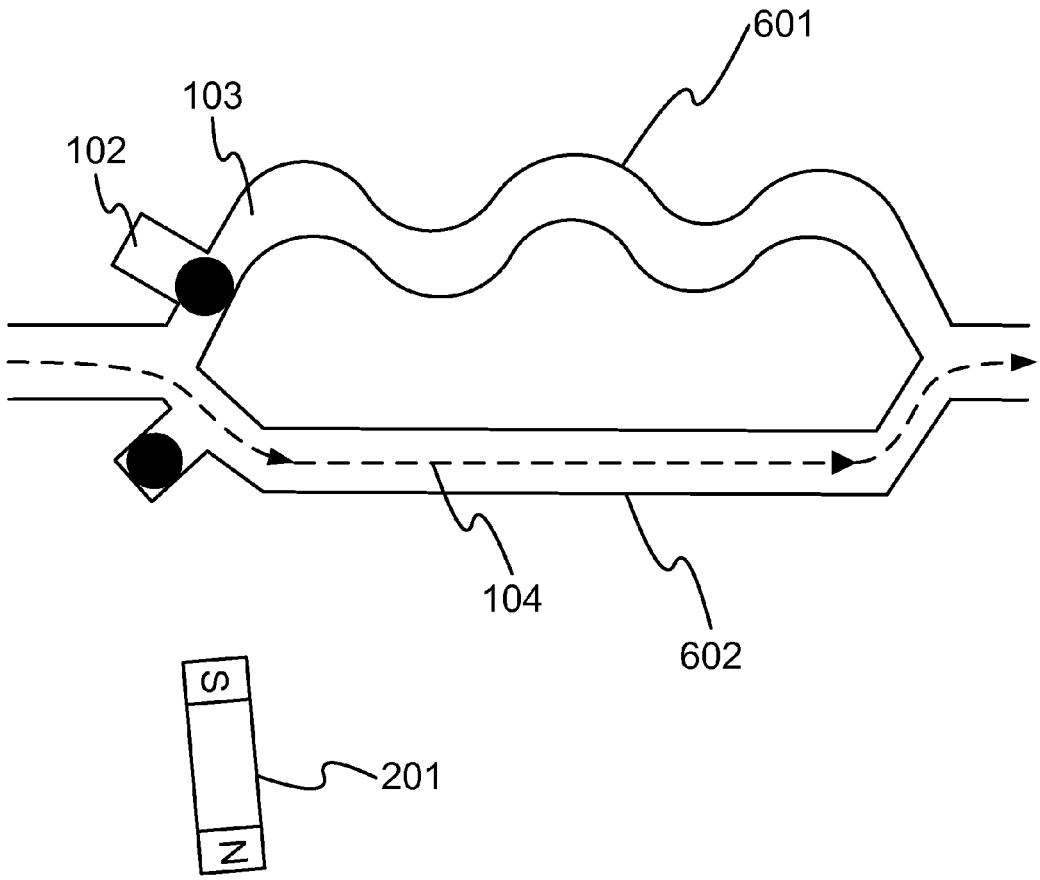

In one example, magnetically actuated valves direct a liquid in a microfluidic system in one of several flow paths wherein the mixing characteristics of the paths are different (601 vs. 602). That is, the extent of mixing has been boosted only in one or more of the channels (and not all) using any of the available methods, such as application of static mixers or curved routes (601) as in FIGS. 6 and 7.

Figure 8:
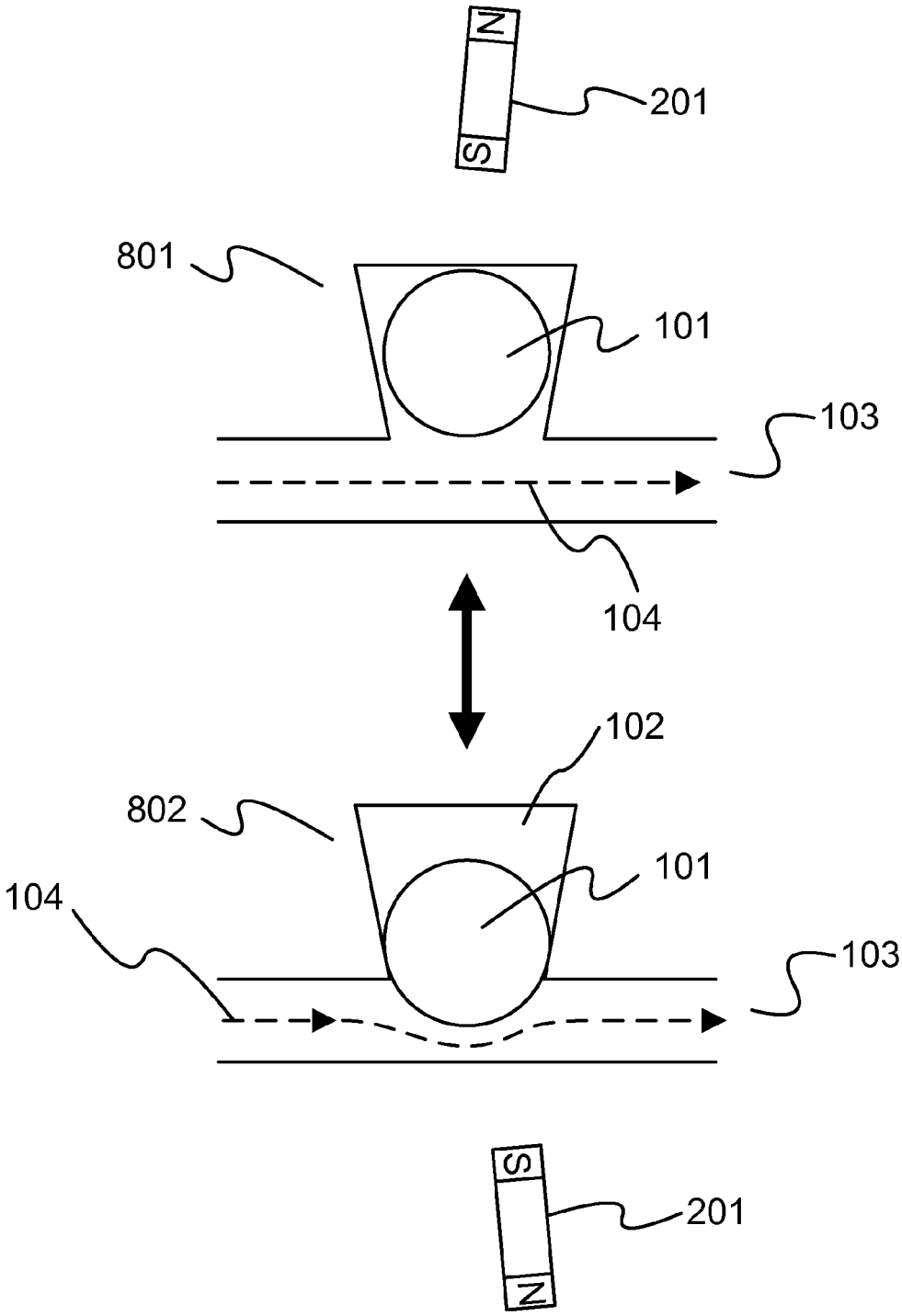
FIG. 8 illustrates schematically another configuration of the present invention to controllably create mixing in flow streams. Mixing is boosted by forcing the bead into partially blocking the stream.

In one embodiment, greater degrees of mixing can be achieved by using a tapered valve cavity whose opening is smaller than the diameter of the magnetic bead. As a result, when the bead is magnetically pulled toward the section of channel attached to the valve, the flow is only partially blocked (constricted) by the magnetic bead as shown in FIG. 8 (bottom section, 802).

Figure 9:
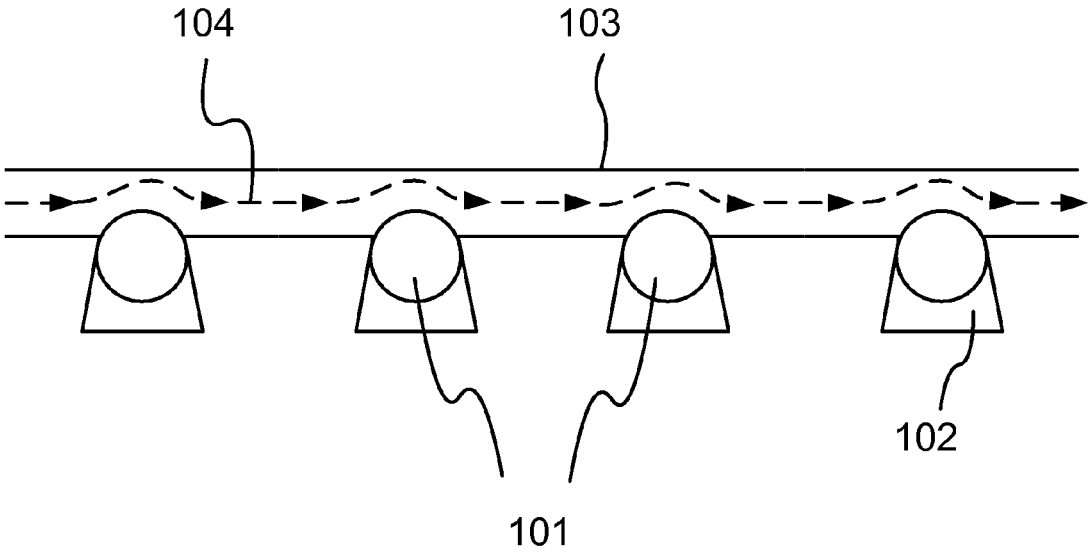
FIG. 9 illustrates schematically another configuration of the present invention to controllably create mixing in flow streams. Mixing is boosted by using multiple partially blocking magnetic valves.
Figure 10:
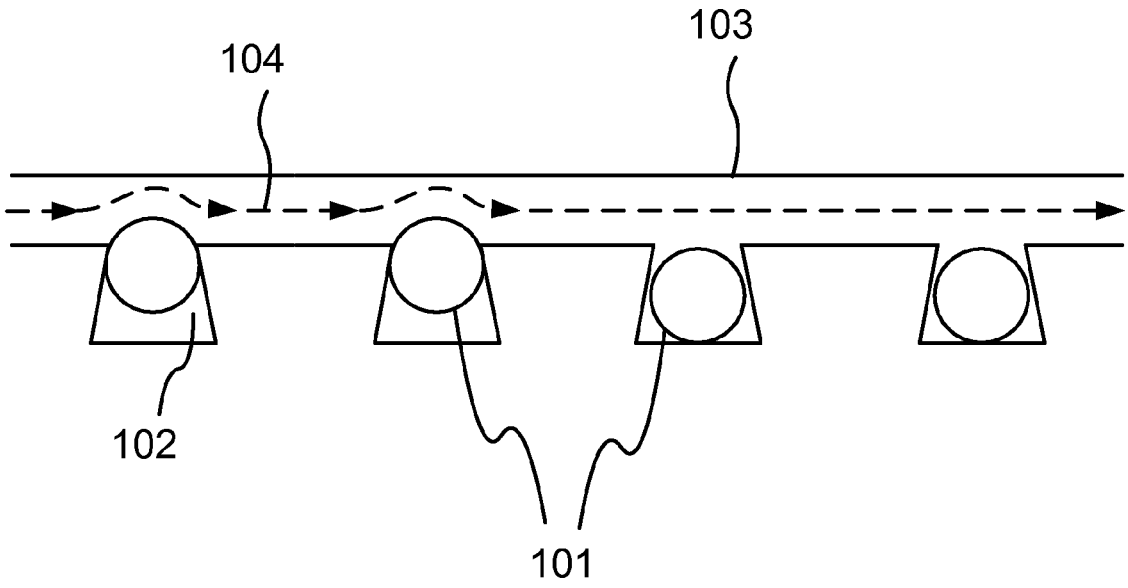
FIG. 10 illustrates schematically another configuration of the present invention to controllably create mixing in flow streams. The extent of mixing is controlled by somehow actuating some of the magnetic valves and not all of them.
Figure 11:
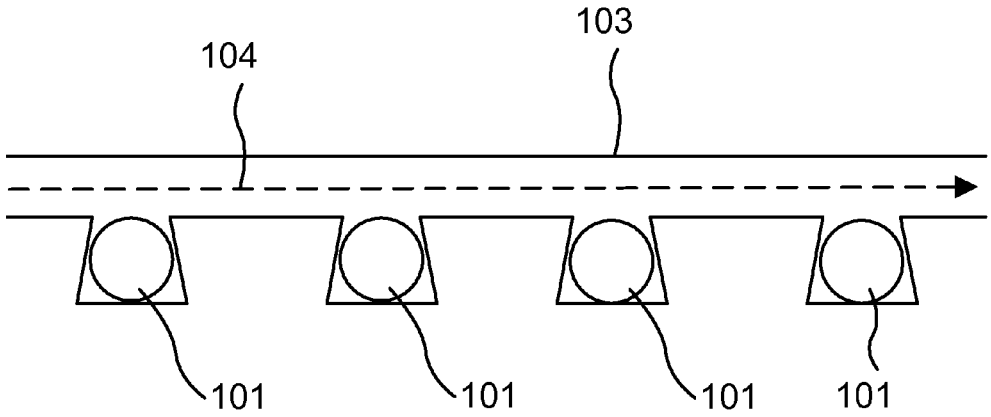
FIG. 11 illustrates schematically another configuration of the present invention to controllably create mixing in flow streams. The extent of mixing is at minimum when all of the magnetic valves are open.

The velocity of the liquid, and its Reynolds number, increases at the reduced flow cross-section and causes a higher degree of mixing of the fluid as it passes the narrowed channel. The extent of mixing can be regulated using a queue of such valves with tapered walls (FIGS. 9, 10, 11). Depending on the location range of the magnet, maximum degree of mixing is attained when all of the beads on the queue are partially blocking (802) the channel (FIG. 9) and the mixing is minimum when all of the beads are in the open position (801) as shown in FIG. 11. Intermediate degrees of mixing are also possible, corresponding to the magnet's location range. An example is shown in FIG. 10.

In several other embodiments, methods to partially close some of the valves while the others are open are shown in FIGS. 12-15. In these embodiments, the valves are placed on two perpendicular microchannels and just one guiding magnet is enough to properly actuate the valves to gain the desired mixing. Some valves, depending on the location of the magnet, shift status to "partially closed" or constrained (802), and some shift status to "open" or ON (801), reversibly. Other configurations and angles are possible.

Figure 12:
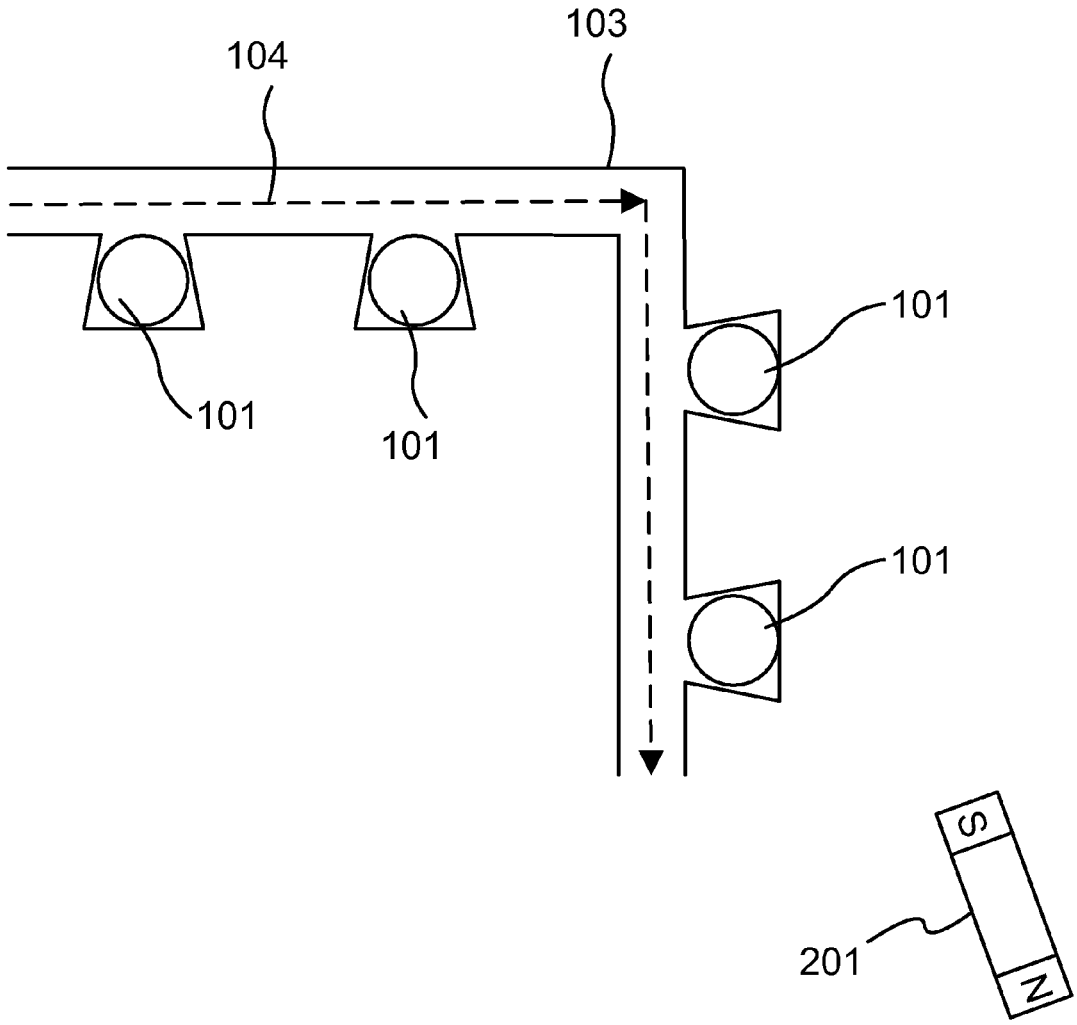
FIG. 12 illustrates schematically how, in one embodiment, all of the magnetic valves are actuated to "open" position using only one magnet.
Figure 13:
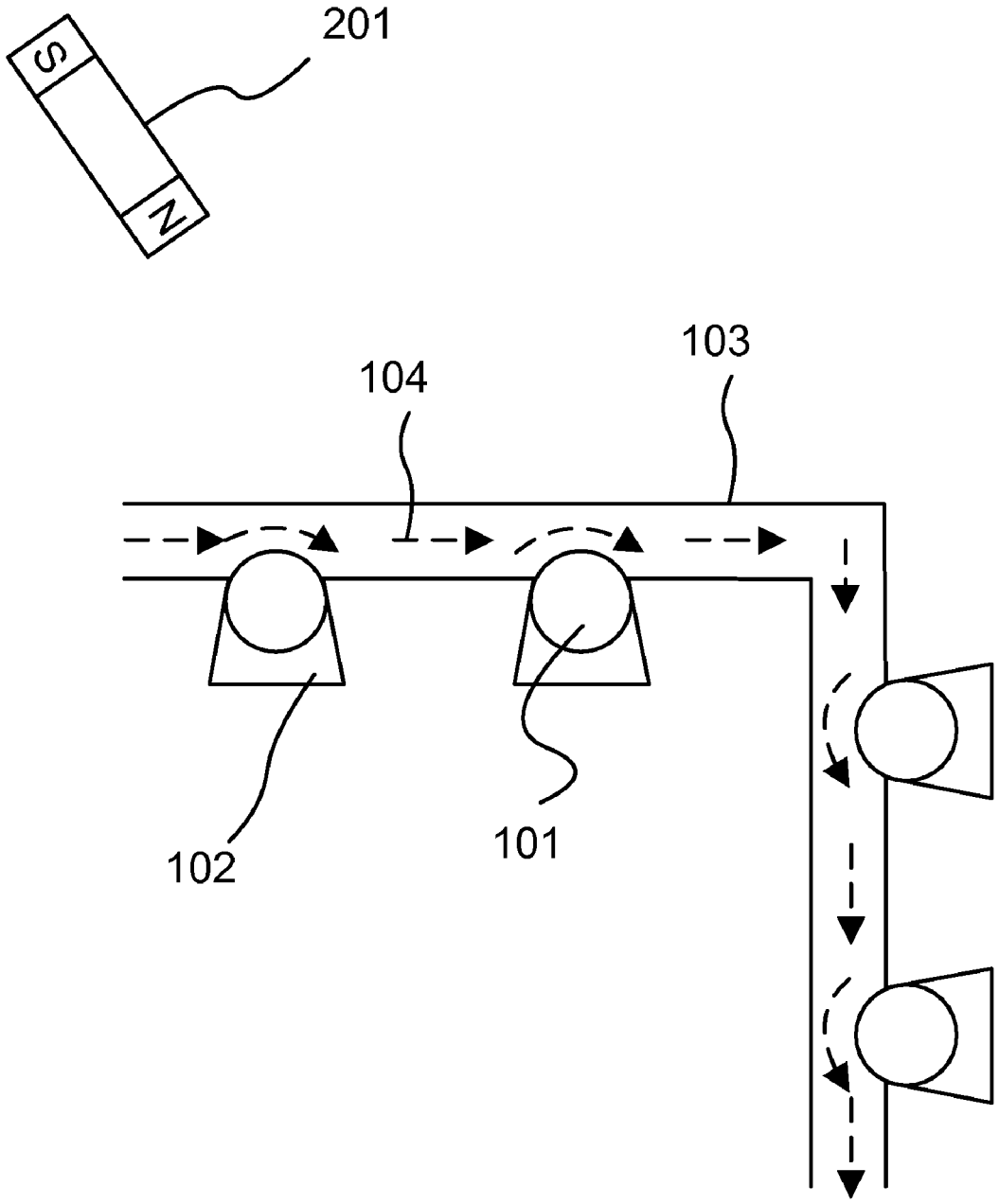
FIG. 13 illustrates schematically another configuration of the present invention, in increasing the extent of mixing in the flow using a magnet.
Figure 14:
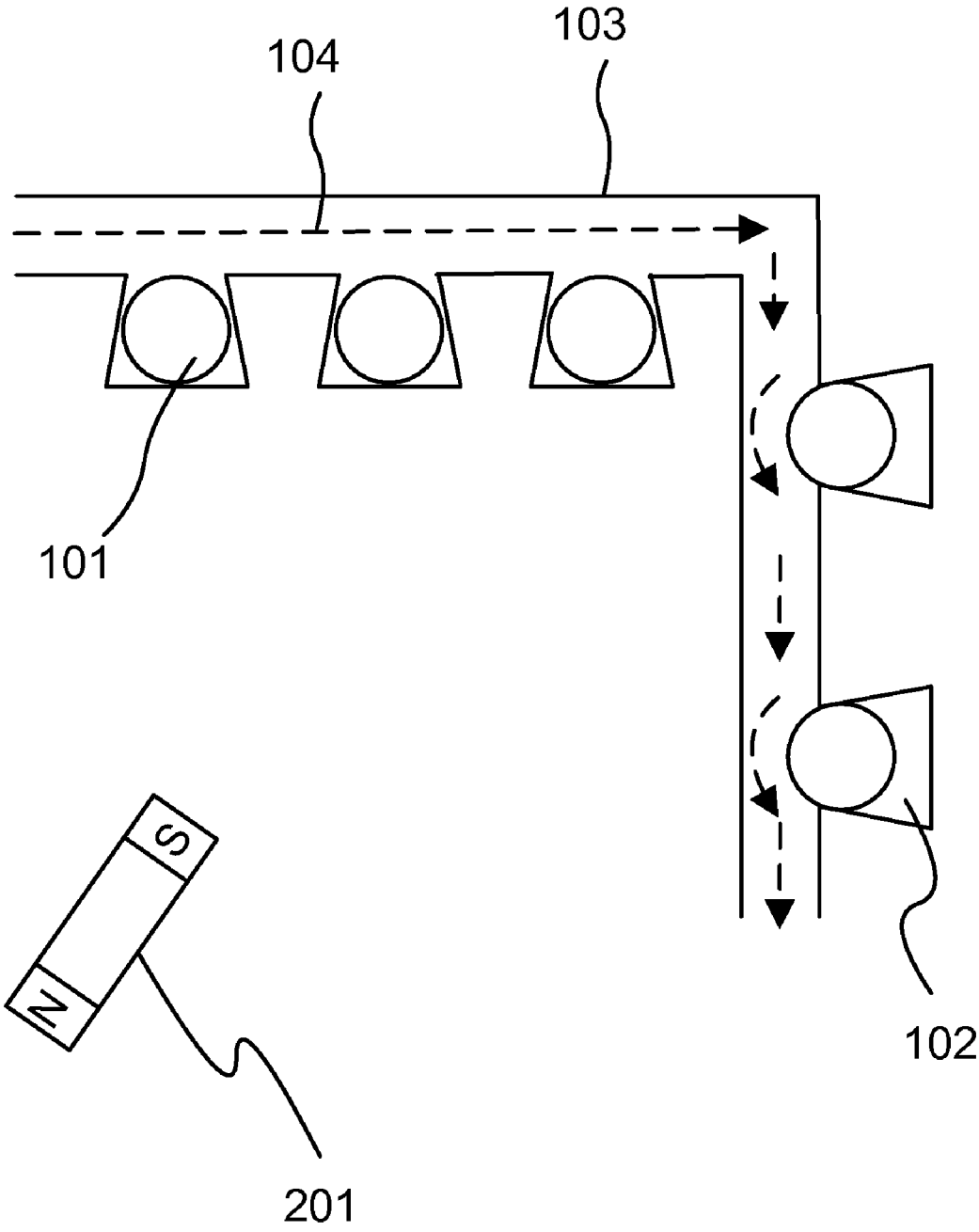
FIG. 14 illustrates that the extent of mixing can be regulated using different number of valves on elbowed channels. In this case, the microchannels are perpendicular and less mixing is desired.
Figure 15:
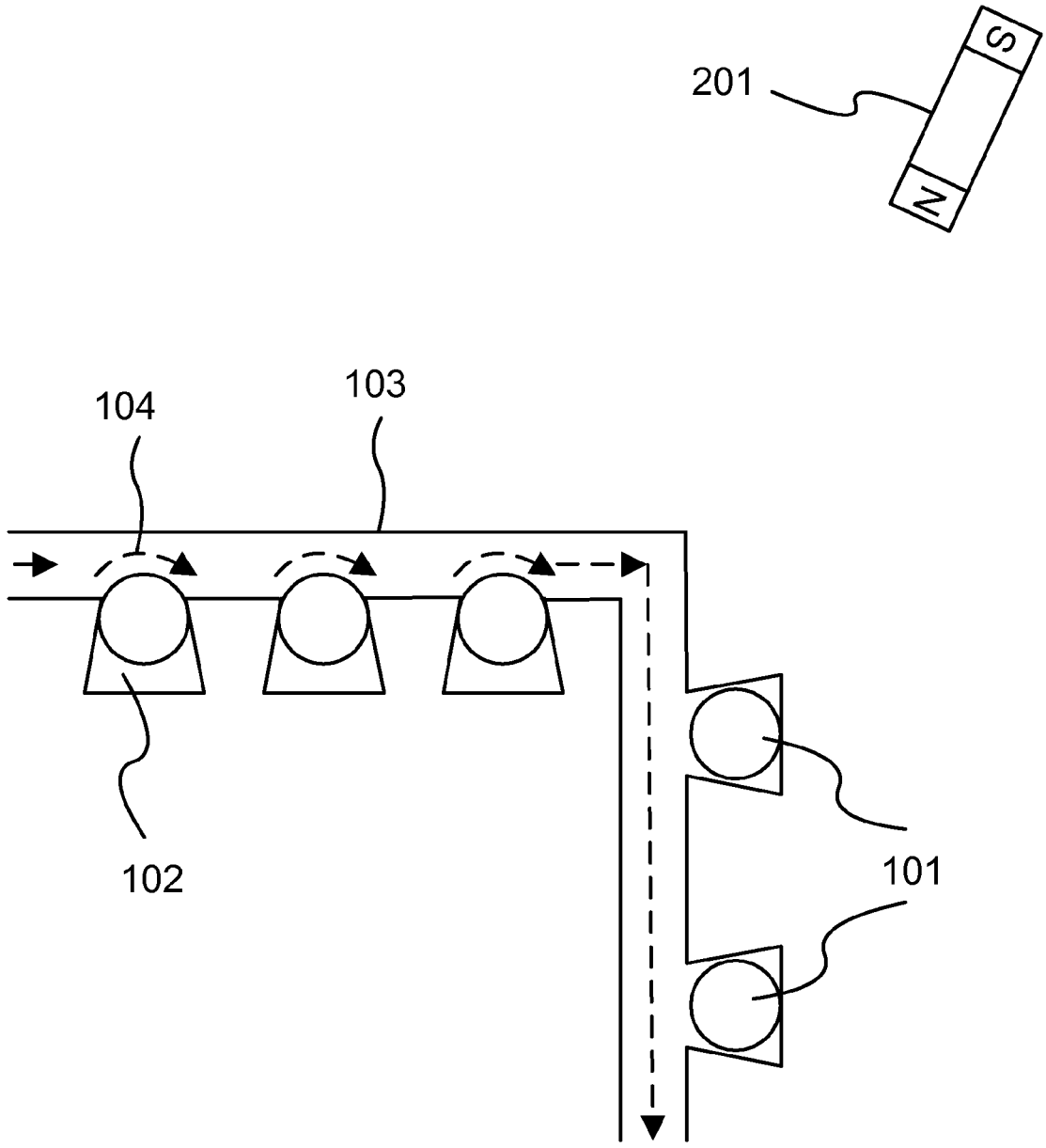
FIG. 15 similarly illustrates that the extent of mixing can be regulated using different number of valves on elbowed channels. In this case, the microchannels are perpendicular and more mixing is desired.

Configuration shown in FIG. 12 represents the minimum mixing in an elbow configuration, whereas FIG. 13 shows the situation which brings about the highest mixing in the same setup. Mixing can be generated in intermediate degrees too as in FIGS. 14 and 15. The extent of mixing produced in the case shown in FIG. 14 is less than that produced in the case shown in FIG. 15. This is because, in the latter case, the number of constricted beads in the route of the flow is larger and therefore more mixing is expected to occur.

In one embodiment, the valves can be actuated by hand by moving a magnet in the vicinity of the valve in one direction. Several such routes or position ranges are possible. Placing the magnet within the position ranges can actuate one or more valves as desired. Such actuation is reversible, the corresponding fabrication is simple and inexpensive, no peripheral equipment is needed (the magnet excepted), its use is simple and valves can be actuated at any time during use of the microfluidic system even by a non-expert user.

An method, device, or an article of manufacture comprising any one of the following steps, features, or items is an example of the invention: magnetically actuating, mixing, producing a proximal magnetic field, placing the guiding magnets in a vicinity of magnetic valves, controlling fluid flow, preventing the magnetic bead from completely blocking the flow, enhance mixing, providing chemical resistance, coating, reducing friction or stiction, covering the particle, using perfluorinated layer as coating, using dyes, SATI, partially closing valves, constricting state valves, regrouping, redirecting, distributing, increasing/decreasing flow, stopping flow, delaying flow, pressurizing fluid, compressing flow, shock waves in the flow, laminar flow, turbulent flow, opening/closing valves or devices, harmonizing the operation of valves or their subgroups, using dust, mixtures, liquids, fluids, gasses, at room temperature, at low temperature (Liquid Nitrogen or Helium), or using the apparatus or system mentioned above, for the purpose of the current invention or magnetically actuating microfluidic mixers.

Any variations of the above teaching are also intended to be covered by this patent application.

The invention claimed is:

1. An apparatus for mixing of microfluidic streams on a chip, said apparatus comprising:

a micro-channel on said chip; and a plurality of magnetic valves on said chip;

wherein a guiding magnet produces a proximal magnetic field gradient at a location of each of said plurality of magnetic valves when an operator places said guiding magnet in a vicinity of said chip;

wherein a first magnetic valve of said plurality of magnetic valves controls fluid flow in said micro-channel;

wherein each magnetic valve of said plurality of magnetic valves comprises a magnetic bead and a cavity on said chip next to a corresponding micro-channel section of said micro-channel;

wherein said magnetic bead comprises:

a magnetic volume element;

wherein said magnetic volume element forces said magnetic bead to move along a cavity length of said cavity in response to said proximal magnetic field gradient, and a bead surface cover, wherein said bead surface cover provides chemical resistance and reduces friction and stiction of said magnetic bead within said cavity;

wherein said cavity length is perpendicular to said corresponding micro-channel section, and said cavity length has a closed end away from said corresponding micro-channel section and an open end at said corresponding micro-channel section;

wherein said open end is tapered so to prevent said magnetic bead from completely blocking said corresponding micro-channel section;

wherein said each magnetic valve is at an on-state, if said magnetic bead is at said closed end of said cavity length allowing an unconstraint fluid flow through said corresponding micro-channel section;

wherein said each magnetic valve is at a constricting-state, if said magnetic bead is at said open end of said cavity length and partially blocking fluid flow through said corresponding micro-channel section by narrowing a fluid path at said corresponding micro-channel section to enhance said mixing of microfluidic streams at said narrowed fluid path;

wherein said vicinity of said chip comprises a plurality of guiding magnet position ranges;

wherein said operator repositions guiding magnet within said plurality of guiding magnet position ranges in order to actuate said plurality of magnetic valves simultaneously;

wherein if said guiding magnet is within a maximum mixing position range of said plurality of guiding magnet positions ranges, then each magnetic valve in said plurality of magnetic valves is simultaneously at said constricting-state;

wherein if said guiding magnet is within a high mixing position range of said plurality of guiding magnet positions ranges, then simultaneously, each magnetic value in a first subset of said plurality of magnetic values is at said constricting-state, and each magnetic valve in a second subset of said plurality of magnetic valves is at said on-state, wherein each magnetic valve in said plurality of said magnetic valves is either in said first subset or in said second subset;

wherein if said guiding magnet is within a low mixing position range of said plurality of guiding magnet positions ranges, then simultaneously, each magnetic value in said first subset is at said on-state, and each magnetic valve in said second subset is at said constricting-state; and wherein if said guiding magnet is within a minimum mixing position range of said plurality of guiding magnet positions ranges, then each magnetic valve in said plurality of magnetic valves is simultaneously at said on-state.

* * * * *